US005811606A

United States Patent [19]

Yang

[11] Patent Number: 5,811,606

[45] Date of Patent: Sep. 22, 1998

[54] PROCESS AND EQUIPMENT FOR TREATMENT OF WASTE PLASTICS

[75] Inventor: Yali Yang, Beijing, China

[73] Assignee: Plastic Advanced Recycling Corp., Burr Ridge, Ill.

[21] Appl. No.: 607,701

[22] Filed: Feb. 27, 1996

[30] Foreign Application Priority Data

Nov. 23, 1995 [CN] China ..... 95117515.7

[51] Int. Cl.[6] ..... C07C 1/00; C07C 7/13

[52] U.S. Cl. ..... 585/241; 585/820; 585/850

[58] Field of Search ..... 585/241, 240, 585/850, 820

[56] References Cited

U.S. PATENT DOCUMENTS

| | | | |
|---|---|---|---|
| 4,251,500 | 2/1981 | Morita et al. | 423/449 |
| 4,664,777 | 5/1987 | Hudson et al. | 208/112 |
| 4,851,601 | 7/1989 | Fukuda et al. | 585/241 |
| 5,079,385 | 1/1992 | Wu | 585/241 |
| 5,208,404 | 5/1993 | Lu | 585/241 |
| 5,233,109 | 8/1993 | Chow | 585/241 |
| 5,389,691 | 2/1995 | Cha et al. | 521/41 |

OTHER PUBLICATIONS

Hobson et al., (editors), Modern "Petroleum Technology", Applied Science Publishers, Ltd, (1973) pp. 241–245.

Speight, J, "The Chemistry and Technology of Petroleum", Marcel Dekker Inc (1991), New york, pp. 514–524, 661–679.

*Primary Examiner*—Glenn Caldarola
*Assistant Examiner*—Bekir L. Yildirim
*Attorney, Agent, or Firm*—Ladas & Parry

[57] ABSTRACT

A process for treating waste plastics includes adding the waste plastics and a catalyst into a reactor for catalytic cracking reaction at 280°–480° C., removing the solid impurities in the generated vapor, condensing the vapor in condenser, and returning the non-condensable gas to be burnt in the heating furnace, distilling and separating the condensate to obtain gasoline and diesel oil which will be stabilized to get high quality gasoline and diesel oil. The equipment includes an automatic hydraulic feeder, a reaction vessel, a gas settler, a condenser series, a vacuum discharge device for solid residue, a rectification tower, mixing tanks, and a final product tank.

8 Claims, 1 Drawing Sheet

PROCESS AND EQUIPMENT FOR TREATMENT OF WASTE PLASTICS

FIELD OF THE INVENTION

This invention relates to a process and equipment for treatment of waste plastics, particularly for those waste plastics such as polypropylene (PP), polyethylene (PE), and polystyrene (PS) without any cleaning and pretreatment operation.

BACKGROUND OF THE INVENTION

With the rapid development of plastic industry, plastic articles are getting increasingly important in industrial production and involving in every field of our daily life. More and more waste plastics come out with the abundant applications of plastics. Because the waste plastics are almost non-decompositionable in natural condition, it becomes a serious problem to our survival environment. So it becomes very important to solve the pollution problem in our environment caused by the waste plastics, and to get them recycled and utilized.

So far, various methods to treat waste plastics have been proposed. Generally, catalytic and thermal cracking may be carried out under the action of catalyst. A method of treating waste plastics in U.S. Pat. No. 4,851,601 includes disintegration of waste plastics, and thermal cracking of the disintegrated waste plastics in a vessel. Then the gas product of the thermal cracking is further cracked with catalysts, such as ZSM-5 with medium-sized pore diameter. Finally, the resulting products are separated by a conventional method. A method of rapidly converting waste plastics into a high quality oil is disclosed in JP-A-5-345894, which includes thermal cracking of waste plastics at 200°–700° C., and then catalytic cracking at 230°–650° C. with catalysts. A method of treating waste plastic films is also disclosed in JPA-62-015240, which includes thermal cracking at a high temperature, condensing the gas products in a primary condenser, separating the gas and liquid phase, and liquefying the gas to obtain light and heavy oil in a secondary condensing stripping column.

There are some existing defects in the above mentioned technologies:

1. Pretreatment operation is needed for starting or raw materials. Thus, extra time, labor and energy are needed. It will cause operation difficulty, especially in winter time.
2. The process of thermal cracking and catalytic cracking are proceeded separately at repeated high temperature. Hence, the energy consumption will be large due to the very high temperature needed in the process.
3. The catalysts have low efficiency at the low temperature. Serious carbonization of raw material will occur at the high temperature, and the oil recovery is low due to the high loss of dry gas.
4. The product obtained has a low stability against oxidation, being easy to be oxidized to form gummy material, and cannot be stored for a long time.
5. The capacity of such processing units are too small to get an economic efficiency.

SUMMARY OF THE INVENTION

This invention is aimed at the treatment of waste plastics that will overcome the defects of the existing technologies. It is simple in process, stable in operation, satisfactory in catalyst quality, easy in maintenance and has a long operational cycle.

It is also an objective of the present invention to provide a whole set of equipment to realize the process of this invention.

Accordingly to this invention, the process for treating waste plastics includes the steps of:

(1) adding directly waste plastics into a reactor together with a proportional amount of a catalyst;

(2) heating the waste plastics added in the reactor at a temperature of about 280° C. to about 480° C. to generate a liquid phase and a gas effluent;

(3) condensing the gas effluent in a condenser to obtain a condensate, and sending non-condensable gas of the gas effluent to a heating furnace for burning as fuel;

(4) transmitting the condensate from the condenser through an oil-water separator to obtain an oil phase product, said oil phase product being brought into a mixing tank, and adding 3–8% (Wt.) of the catalyst mentioned in step (1) in the mixing tank under the room temperature, to improve the stability of the oil phase product against oxidation;

(5) refining the oil phase product obtained from step (4) to produce gasoline, diesel oil, and other hydrocarbon fractions.

The related equipment of this invention for treatment of waste plastics includes an automatic hydraulic solid feeder, a reaction vessel or rector, a settler, a series of condenser, a vacuum discharge device for dischanging solid residue, a rectification tower, a tower reboiler, a mixing tank, a final product tank.

DETAILED DESCRIPTION OF THE INVENTION

Figure 1:
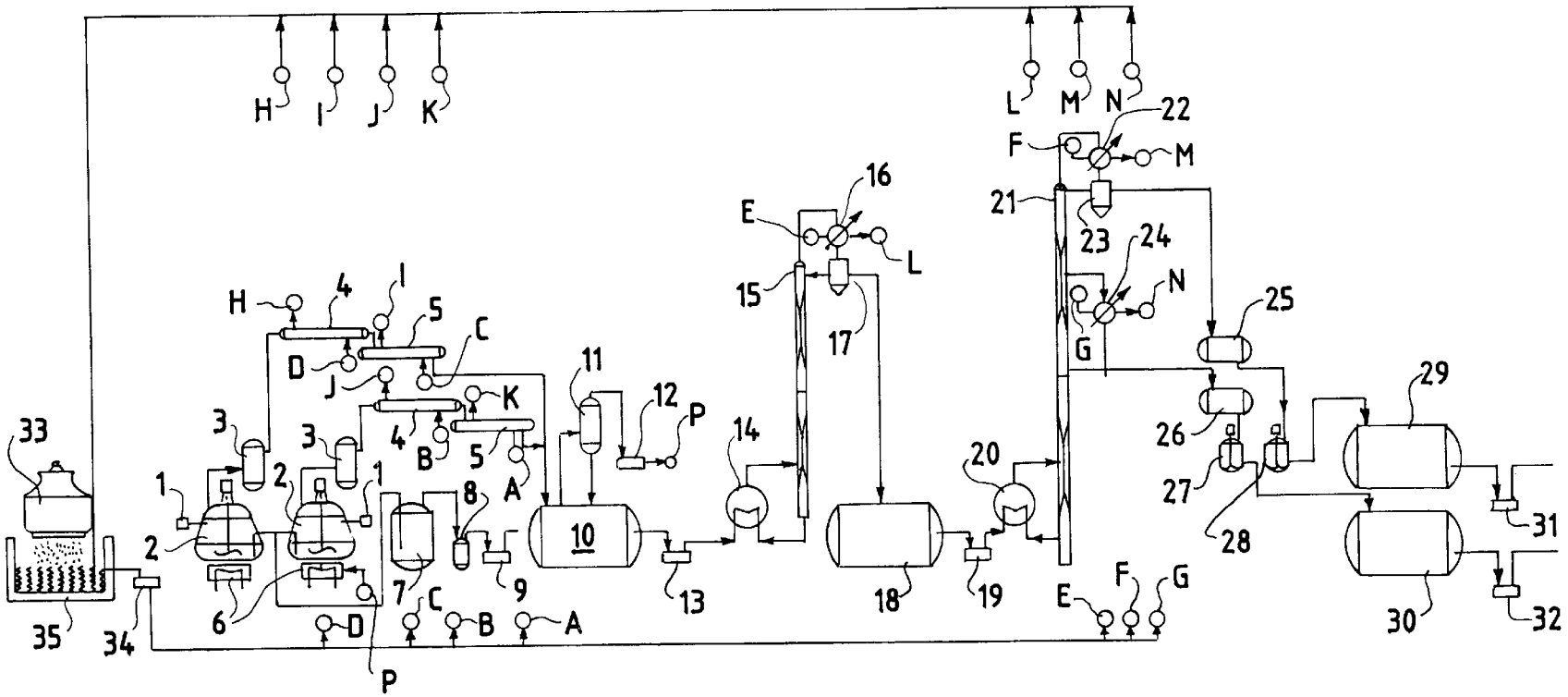
FIG. 1 is the schematic diagram for implementation of the equipment of this invention.

With reference to FIG. 1, this invention is explained in detail. A method of treating waste hydrocarbon plastics of this invention comprises the steps of:

(1) adding directly waste plastics into a reaction vessel or rector together with a proportional amount of a catalyst at the same time;

(2) heating the added waste plastics at a temperature of about 280° C. to about 480° C. to generate a liquid phase product and a gas effluent;

(3) condensing the gas effluent generated from the reactor, after setting off solid impurities therefrom, in a condenser to obtain a condensate, and sending non-condensable gas for burning in a heating furnace;

(4) separating the condensate from water in a settler by vaporization and transmitting the separated condensate to a rectification tower, in which light fractions are obtained from the top of the rectification tower, and the heavy fractions are from the middle part of the rectification tower;

(5) transmitting the light and heavy fractions obtained from step (4) into a mixing tank separately, and under the room temperature adding the catalyst mentioned in step (1) in an amount of 3 to 8% by weight of the two fractions fed, in order to improve the stability of a mixed product against oxidation; and (6) refining the mixed product from step (5) to obtain final products.

According to this invention, the catalyst used comprises a silica carrier and a mixture of active components having the following formula:

$A_aB_bAl_cM_dNa_eCa_fFe_gO_x$

Where A is selected from the group consisting of potassium, barium, phosphorus, vanadium, chromium and rare earth elements and their mixture, and B is selected from the group consisting of molybdenum, nickel, germanium, platinum and their mixture, and m is tungsten, and wherein a is from 25.00 to 26.35%; b is from 36.00 to 37.05%; c is from 7.20 to 9.00%; d is from 1.14 to 1.55%; e is from 1.75 to 2.15%; f is from 2.40 to 2.80%; g is from 2.42 to 3.20%; and x is the sigma weight of oxygen atom needed to the chemical bonding valences of the various components in the catalyst, which is based on the total weight of the catalyst; and wherein the content of silica carrier in the catalyst is from 20 to 35% by weight.

According to this invention, the waste plastics used as raw or starting materials include waste PP, PE and PS, except waste PVC (polyvinyl chloride).

According to this invention, the feeding equipment can be a hydraulic piston type, and can be manually or automatically controlled according to various requirements. The heating device 6 can use any fuels, such as coal, electricity or oil according to different conditions.

In this invention, the temperature for the liquid phase in the reaction vessel 2 should be controlled from about 280° to about 480° C. The gas effluent generated from catalytic cracking are a mixture of hydrocarbons $C_1$–$C_{20}$ during the complete period of gas production. The temperature of the gas phase varies with the feeding process continuously from about 90° C. to about 300° C. The best quality of the product is obtained when the temperature is 195° C.±30° C., and the largest flow rate of the product per unit time is obtained when the temperature is 230° C.±20° C. The optimal temperature is controlled at 195° C.±30° C.

In this invention, the condensate is a mixture of liquid hydrocarbons $C_5$–$C_{20}$, with the distribution of alkane accounting 30 to 38%, alkene 45 to 48%, aromatic hydrocarbon 15 to 23%, and cyclane 10 to 15%. The condensation is proceeded in the condenser series, including a primary condenser 4 and a secondary condenser 5. The gas effluent from the reactor 2 enters into the settler 3. Most of solid impurities carried by the gas phase settle on the bottom of the settler 3 under the influence of 40# Intalox stainless steel packing. Then, the clean gas enters into the tube side of the primary condenser 4, with its temperature ranging from atmospheric temperature to 300° C. Then the gas and liquid mixture enters into the shell side of the secondary condenser 5 that ensures enough heat exchanging areas to condense the mixture of hydrocarbon vapors.

According to this invention, the non-condensable components $C_1$–$C_4$ in the gas mixture that is generated in the reactor will be collected in the "tail gas collector". The collected gas will be sent to the furnace 6 of the reactor 2 by a Nash-Hytor pump 12 to prevent back-fire and eliminate the pollution problem. The catalyst is proportionally fed into the reactor 2 with the successive addition of raw material, and undertaken the catalytic cracking reaction, including decomposition, isomerization and hydrogen-transfer reactions.

The treatment in the mixing tank is to make the unstable fraction of the condensate, which is mainly unstable alkene such as diene, to undertake isomerization, aromatization and hydrogen transfer reactions, thereby converting it into a product which is stable against oxidation. In the mixing tank, new catalyst should be used, and operated at an atmospheric temperature. The amount of the new catalyst is from 3 to 8% of the weight of the condensate mentioned above. The operation cycle of catalyst is from 0 to 25 with the optimal value of 15. The catalyst used in the reactor may be those discharged from the mixing tank, while its total amount will be correspondingly increased.

According to this invention, the refinement may be proceeded in the rectification tower. For example, the tower can be equivalent to 8 theoretical plates, with a reflux ratio of 4, using a structured tower packing (such as a protruded corrugated packing). Thus, gasoline and diesel oil, which are fuel oils, can be produced respectively. Moreover, a further refining separation from the condensate can be proceeded to acquire more valuable components of hydrocarbons, such as olefins and aromatic hydrocarbons.

When the condensate is refined to get gasoline and diesel oils, the rectification tower 21 should be equivalent to 16 theoretical plates, with a reflux ratio of 5, using 25 mm Intalox stainless steel tower packing. When the condensate is refined to get gasoline and diesel oil in the fractionating tower, there should be separated stream lines for discharge, reflux, storage and treatment, rather than the batchwise method to obtain both fractions.

When the condensate is refined to get gasoline and diesel oil, the initial distilling temperature for gasoline is 31° C. with the ending point of 200° C. Its amount approximately constitutes 52 to 58% of the total amount of the hydrocarbon mixture. Its octane number is 78 (MON), or 86 to 88 (RON). The quality meets with the National Standard for 70# gasoline (MON 70#). The distillation temperature range of the diesel oil is 200°–360° C., and its amount constitutes 42 to 48%. Its quality meets with the National Standard for minus 15# diesel oil.

The obtained gasoline and diesel oil are reserved in a head tank separately, then sent respectively into their mixing tanks to be further treated to improve their stability. The treated product will be of high stability.

The equipment of this invention is shown in FIG. 1, and explained in detail below. As shown in FIG. 1, the equipment includes a reaction vessel or rector 2, which has a cone-shaped body. A feeding nozzle is provided at the upper part of the vessel 2, while a solid residue discharging nozzle is at its lower part. The feeding nozzle is connected with an automatic hydraulic feeder 1 to perform continuous feeding. The solid residue discharging nozzle is connected with a vacuum discharging system 7, 8, 9, so that residues after reaction can be removed automatically. When the reaction vessel 2 is heated, the raw or starting material will be transformed from a solid to a liquid state with the increasing temperature. Further, when the liquid is being converted into a gas phase under the action of the catalyst, the gas generated will be condensed into a mixture of liquid hydrocarbons through the condenser series 4 and 5, before which the dust impurities carried by the gas should be pre-separated in the settler 3.

The mixture of liquid hydrocarbons thus condensed is treated to remove water and other solid impurities in the tank 10. Then, the treated mixture is sent by an oil pump 13 to the heater 14 to be vaporized. The vapor enters the stripping tower 15 and be condensed in the condenser 16. A mixture of liquid hydrocarbons will be obtained, wherein the water will be removed through the separator 17 and the mixture is thus stored in the tank 18. The mixture of liquid hydrocarbons in the tank 18 enters the heater 20 through the oil pump 19, and goes into the rectification tower 21.

The mixture is separated into gasoline and diesel oil fractions according to the different temperatures needed. The gasoline vapor enters the condenser 22 from the top of the tower and condensed into a liquid phase. The water layer is removed in the separator 23. The oil layer forms the reflux flow and gasoline distillate, which enters into the head tank 25, then into the mixing tank 28 where it is treated with the catalyst as mentioned above. The treated gasoline is stored in the final storage tank 29. The final gasoline product is output through the oil pump 31. The diesel oil fraction enters into the condenser 24 from the middle part of the rectification tower 21, and then through the head tank 26, enters into the mixing tank 27, where the diesel oil is treated with catalyst as mentioned above. The treated oil is sent to the storage tank 30. The final diesel oil product is output through the oil pump 32.

Non-condensable components $C_1$–$C_4$, generated from the catalytic cracking in the reactor 2 is collected in the tail gas collector 11 and the water is scrubbed with the glass packing layer in it. Through the Nash-Ilytor pump 12, the non-condensable components are and sent into the heating furnace 6 to be burnt.

Cooling medium in this process is circulating water, which is circulated through the water cooling tower 33, and water pool 35. It is then sent by the water pump 34 to all heat exchangers, where A–G are the cooling water supplying lines, H–N the recycling lines.

This invention predominates in this field now, compared with similar process developed domestically or abroad. It has the advantage of the stable operation, simple technology, excellent performance of the catalyst and long operation period without breakdown. This process and related equipment are based on the intrinsic property of raw materials. It can treat various waste plastics except PVC and other plastics containing chlorine. This process can eliminate environmental pollution caused by the waste plastics, and obtain useful fuel oil products or other hydrocarbon fractions. Hence it is a feasible and satisfactory technology to eliminate "white pollution" problem.

This invention has the unique characteristics as follows:

1. The catalyst used in this invention has wide suitability and catalytic activity, at a relatively low temperature for different raw materials.
2. In this process, the product obtained from the catalytic cracking of waste plastics has a satisfactory distribution of hydrocarbons of gasoline, diesel oil and other fractions. The content of olefins is relatively high, so that it is regarded to have high unstability theoretically and easy to form gummy substances, but in fact because of the excellent performance of the catalyst used in this invention, it restrains the content of the unstable unsatuate hydrocarbons in the treated product, and upgrade the stability against oxidation of final products.
3. In this invention, a uniquely designed mixing tank is used to give further particular treatment of product with an excellent catalyst, which improves the stability of the product and makes the product to be stored easily and stably.

Further explanation to this invention are presented by examples as follows:

EXAMPLE 1

100 Kg of catalyst contains 22% silica by weight as a carrier. The remaining part includes active components with the following formula:

$$A_aB_bAl_cM_dNa_eCa_fFe_gO_x$$

Where A represents potassium and barium, B represents molybdenum, M is tungsten. a is 26.25% (Wt.); b is 37.05%; c is 7.20%; d is 1.14%; e is 1.75%; f is 2.40%; g is 2.42%; x is the sigma weight of oxygen atom needed to the chemical bonding valences of various components in the catalyst.

The above catalyst and 5000 Kg uncleaned waste agricultural plastic films are added into a $6_m^3$ reactor continuously. The mixture is heated gradually. The temperature is controlled between 337° and 389° C., causing the catalytic cracking reaction. The temperature of vapor in the upper part of the reactor is controlled between 210° and 267° C. The temperature of vapor entering the condenser is controlled from 91° to 124° C. The solid impurities carried by the vapors generated from the reactor are removed in the settler, obtaining liquid and non-condensable gas products with a yield of 84.3%. After the water in condensate is removed by the separator, the condensate is vaporized and goes to the rectification tower, to get gasoline fractions from the top of the tower and diesel oil fractions from the middle of the tower. The gasoline and diesel oil are respectively transferred into their mixing tanks and treated at an atmospheric temperature, with added catalyst of an amount of more than 3% by weight to the gasoline and diesel oils, to improve the stability of the product. The octane number of the obtained gasoline is MON 78#. The stability against oxidation of the diesel oil is solidification point 10#. After a complete cycle of reaction, there is no carbonization remained in the reactor, and the impurities carried by the raw material and catalyst can be drained out by a vacuum suction from the residue discharging nozzle. Results are presented in table 1 below.

EXAMPLE 2

The process of treatment for waste plastic films is the same as mentioned in example 1, but with different reaction conditions shown in table 1. See table 1 for the results.

EXAMPLE 3

The process of treatment for waste plastic films is the same as mentioned in example 1, but with different reaction conditions shown in table 1. See table 1 for the results.

TABLE 1

| Example | 1 | 2 | 3 |
|---|---|---|---|
| Amount of raw material fed (Ton) | 5 | 5 | 5 |
| Amount of catalyst (%) | 2 | 1.5 | 1 |
| Reaction time (hr) | 11 | 8 | 9 |
| Temperature of liquid phase (°C.) | 337–389 | 341–384 | 315–376 |
| Temperature of vapor phase (°C.) | 91–124 | 89–110 | 83–131 |
| Temperature of top (°C.) | 210–267 | 231–273 | 209–275 |
| Yield (%) | 84.3 | 84.6 | 82.8 |
| Octane number for gasoline | | | |
| Stability against oxidation for diesel oil | | | |

These examples mentioned above are just some non-restrictive description for this invention. For skillful technical persons in this field, various modifications and variation to this invention can be made under proper conditions.

I claim:

1. A process of treating waste plastics through a system including at least a reactor, a condenser, a heating furnace, a rectification tower and mixing tanks, said process comprising the steps of:

(1) adding waste plastics directly into the reactor with a proportional amount of a catalyst comprising a silica carrier and active components having the formula:

$$A_aB_bAl_cM_dNa_eCa_fFe_gO_x$$

where A is selected from the group consisting of potassium, barium, phosphorus, vanadium, chromium, rare earth metals and their mixture, B is selected from the group consisting of molybdenum, nickel, germanium and platinum, and M is tungsten, and wherein a is from 25.00 to 26.35% by weight, b is from 36.00 to 37.05% by weight, c is from 7.20 to 9.00% by weight, d is from 1.14 to 1.55% by weight, e is from 1.75 to 2.15% by weight, f is from 2.40 to 2.80% by weight, g is from 2.42 to 3.20% by weight, and x is sigma weight of oxygen atom needed for chemical bonding valences of the components in the catalyst;

(2) heating the waste plastics added in the reactor at a temperature of about 280° C. to about 480° C. to generate a liquid phase product, and to obtain a vapor after catalytic cracking;

(3) settling and removing solid impurities carried by the vapor generated from the reactor, condensing the vapor in the condenser to obtain a condensate, and sending non-condensable components of the vapor for burning in the heating furnace;

(4) removing water from the condensate by phase separation, and vaporizing and distilling the condensate in the rectification tower to acquire gasoline fractions from the top of the rectification tower, and diesel oil fractions from the midst of the rectification tower;

(5) transferring the acquired gasoline and diesel oil respectively into the mixing tanks to be treated, at an atmospheric temperature, by adding the catalyst mentioned in step (1) in an amount of 3 to 8 percent by weight of the treated oils, thereby improving stability against oxidation of the treated oils; and (6) refining the treated oils from step (5) to obtain end products.

2. The process of claim 1, wherein the catalyst comprises 20–35% by weight of silica carrier.

3. The process of claim 1, wherein the waste plastics include waste PE, PP and PS.

4. The process of claim 1, wherein the temperature of the liquid phase product in the reactor is controlled from 300° C. to 380° C.

5. The process of claim 1, wherein the temperature of the vapor in the reactor is controlled at 90°–300° C.

6. The process of claim 5, wherein an optimal temperature of the vapor is in the range of 190°±30° C.

7. The process of claim 1, wherein an operational cycle of the catalyst used in the mixing tank is in the range of 10 to 25.

8. The process of claim 1, wherein the catalysts used in the reactor can be those used in the mixing tank.

* * * * *